US008327494B2

(12) United States Patent
McWhorter et al.

(10) Patent No.: US 8,327,494 B2
(45) Date of Patent: Dec. 11, 2012

(54) BRUSH MITT

(76) Inventors: Bernice McWhorter, Barton, AR (US); Robert Reyna, Lexa, AR (US)

( * ) Notice: Subject to any disclaimer, the term of this patent is extended or adjusted under 35 U.S.C. 154(b) by 221 days.

(21) Appl. No.: 12/186,289

(22) Filed: Aug. 5, 2008

(65) Prior Publication Data

US 2010/0031465 A1 Feb. 11, 2010

(51) Int. Cl.
*A47L 13/44* (2006.01)

(52) U.S. Cl. ..... 15/247; 15/246

(58) Field of Classification Search ..... 15/247, 15/209.1, 228, 231, 235, 246
See application file for complete search history.

(56) References Cited

U.S. PATENT DOCUMENTS

| | | | | | |
|---|---|---|---|---|---|
| 2,756,449 | A | * | 7/1956 | Dewey | 401/285 |
| 2,875,460 | A | | 3/1959 | Legge | |
| 4,184,221 | A | | 1/1980 | Edwards | |
| 4,831,682 | A | * | 5/1989 | White | 15/246.2 |
| 4,945,599 | A | | 8/1990 | Flynn | |
| D310,902 | S | * | 9/1990 | Paciullo et al. | D32/40 |
| 5,042,105 | A | * | 8/1991 | Buck et al. | 15/247 |
| 5,177,831 | A | | 1/1993 | Wirth | |
| 5,286,019 | A | * | 2/1994 | Watabe | 473/282 |
| 5,343,587 | A | | 9/1994 | Findley | |
| 5,984,360 | A | | 11/1999 | Edwards et al. | |
| 6,745,434 | B2 | | 6/2004 | Smith et al. | |
| 6,779,221 | B2 | | 8/2004 | Bockes | |
| 7,150,063 | B1 | * | 12/2006 | Graham | 15/160 |
| 7,458,128 | B2 | * | 12/2008 | Smith et al. | 15/247 |
| 2002/0179115 | A1 | * | 12/2002 | Alex | 134/6 |
| 2003/0101528 | A1 | * | 6/2003 | Smith | 15/247 |
| 2004/0238001 | A1 | * | 12/2004 | Risden | 134/6 |
| 2005/0160550 | A1 | * | 7/2005 | Reeves | 15/247 |
| 2005/0235446 | A1 | * | 10/2005 | Eggers | 15/220.1 |

* cited by examiner

*Primary Examiner* — Robert Scruggs
(74) *Attorney, Agent, or Firm* — J. Charles Dougherty

(57) ABSTRACT

A brush mitt includes a brush cover and a handle cover. A loop on the brush cover receives a handle of a brush of the type such as commonly used for washing vehicles. The handle cover wraps around the end of the handle and a brush cover attachment strap passes through the loop on the brush cover to secure the handle cover to the brush cover. The brush mitt prevents damage to delicate surfaces, such as the painted surface of vehicles, that might be caused by either the brush bristles or impact with the handle of the brush.

14 Claims, 2 Drawing Sheets

BRUSH MITT

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to washing and cleaning implements, and in particular to mitts designed to fit over brushes used for washing vehicles and the like.

Brushes used for washing vehicles typically comprise a long handle with a head from which a set of bristles extend. The long handle of the brush facilitates cleaning because it allows the operator to easily reach each surface of the vehicle without difficulty. The bristles of the brush are typically formed of nylon or similar materials. The brush bristles hold soapy water that is applied to remove dirt and dust from the vehicle. The soap may be fed to the brush through a hollow handle, such as is common with the brushes used in self-service car washes, or may be applied externally such as by dunking the brush head in a bucket filled with soapy water.

A problem with the brushes typically employed for the washing of vehicles, either for home use or in self-service car washes, is that the bristles tend to scratch the delicate painted surface of automobiles. The bristles also have a tendency to trap dirt particles that can themselves scratch an automobile's surface. While "touchless" automatic washing equipment has become popular as a means to avoid the damage caused by brush bristles, such equipment typically does not provide the same quality of cleaning as an automobile wash performed by means of a brush.

Another problem with the typical brushes used for the washing of vehicles is that the handle of the brush tends to bang into the vehicle as the user moves about the vehicle during the washing procedure. Most vehicles have various parts that extend outwardly, such as rearview mirrors, bumpers, and the like, and these areas are particularly prone to being struck by the handle of the brush. This impact can also cause damage to the finish of the vehicle. While longer handles on vehicle washing brushes make the task easier for the user, they tend to exacerbate this problem.

The art includes a number of efforts to solve the problem of vehicle washing brushes that scratch the painted surface of a vehicle. For example, U.S. Pat. No. 7,150,063 teaches a vehicle wash mitt comprising a soft fibrous external portion that is fitted over the brush portion of a typical vehicle washing brush. The soft material can be, for example, Sherpa or sheepskin. The soft external portion of the mitt protects the vehicle surface from the brush bristles while also providing a surface that may be used to hold soapy water and to scrub the vehicle clean. The mitt is fastened to the brush head by means of hook-and-loop or Velcro attachment strips that fold together over the back of the brush head.

In another example found in the art, U.S. Pat. No. 5,177,831 teaches a cloth covering for a sponge mop such as typically used to mop floors. In this case, the cloth covering is formed in a shape intended to completely cover the sponge head of the mop. It has an opening sized to receive one end of the sponge head for insertion, and Velcro fasteners are used to close up the cloth covering element after the sponge head is inserted.

Although the examples in the art described above may provide a means of preventing damage to vehicles during washing due to scratching by brush bristles, they do not provide a means of protecting the vehicle from damage due to impact by the brush handle. This limitation and others found in the art are overcome by the present invention as described below. References mentioned in this background section are not admitted to be prior art with respect to the present invention.

BRIEF SUMMARY OF THE INVENTION

The present invention is directed to a mitt that protects a vehicle or other delicate surface to be washed from damage caused both by brush bristles and from damage due to impact by the brush handle. The mitt includes a protective sheath portion that wraps around the brush handle to prevent damage by impact with the brush handle.

In one aspect of the invention, it features a brush mitt removably attachable to a brush comprising a handle, a brush head attached to the handle, and a plurality of bristles attached to the brush head, the brush mitt comprising a brush cover removably attachable to the brush head, a handle loop attached to the brush cover and sized to receive the handle through the handle loop, a handle cover removably attachable to the handle; and a brush cover attachment strap sized to be received through the handle loop whereby the brush cover attachment strap secures the handle cover to the brush cover, and thereby prevents slippage of the handle cover longitudinally along the length of the handle.

In another aspect of the invention, it features a washing apparatus comprising a brush comprising a handle comprising first and second ends, a brush head attached at the first end of the handle, a plurality of bristles attached at the brush head, a brush cover removably attachable to the washing apparatus at the brush head; a handle loop attached to the brush cover and sized to receive the handle through the handle loop; a handle cover removably attachable to the handle; and a brush cover attachment strap attached to the handle cover and sized to be received through the handle loop whereby the brush cover attachment strap secures the handle cover to the brush cover.

It is therefore an object of the present invention to provide for a brush mitt that protects a painted vehicle or other delicate surface from damage both by brush bristles and from impact by the brush handle. These and other features, objects and advantages of the present invention will become better understood from a consideration of the following detailed description of the preferred embodiments and appended claims, in conjunction with the drawings as described following:

DETAILED DESCRIPTION OF THE PREFERRED EMBODIMENT(S)

Figure 1:
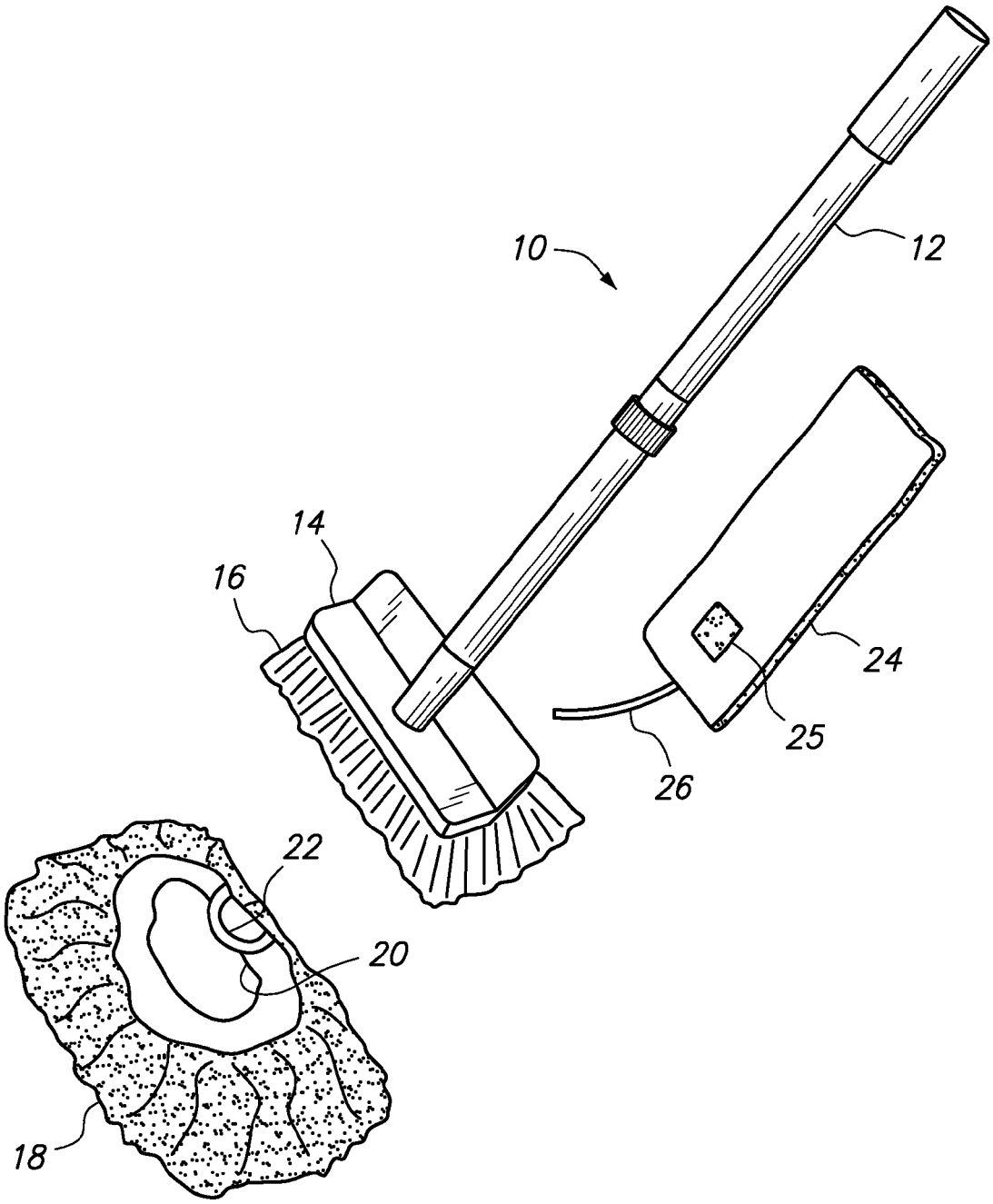
FIG. 1 is a perspective view of a preferred embodiment of the present invention, depicted prior to attachment of the mitt portion of the invention to a brush.
Figure 2:
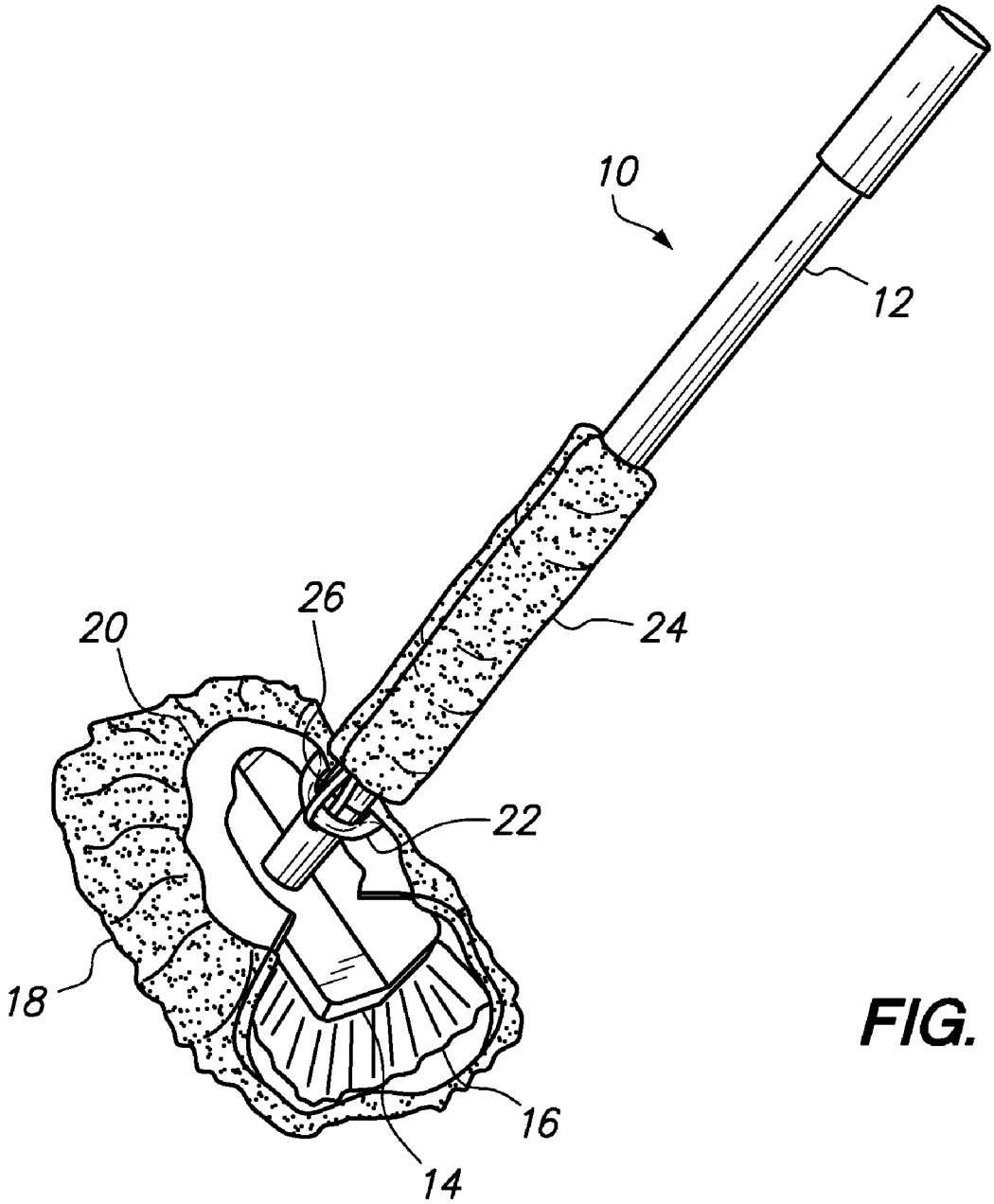
FIG. 2 is a perspective view of a preferred embodiment of the present invention in partial cut-away, depicted after attachment of the mitt portion of the invention to a brush.

With reference to FIGS. 1 and 2, the preferred embodiment of the present invention may now be described.

Brush 10 may be of any commonly employed sort of brush for the washing of vehicles and the like, and features handle 12 and head 14. Handle 12 may be hollow in order to receive soapy water through a hose (not shown) attached to handle 12, as is commonly the case with the brushes used at self-service car washes. Handle 12 and head 14 may be formed of wood, aluminum, plastic, or any other sufficiently rigid and durable material. Bristles 16 extend from brush head 14, and may be formed of nylon, animal hair, or any other bristle material used in brushes.

The mitt portion of the present invention includes brush cover 18 and handle cover 24. Brush cover 18 is sized to fit over brush head 14 and bristles 16. Brush cover 18 may be made of sheepskin or any other soft, porous material that will not damage delicate surfaces such as painted vehicles. In the preferred embodiment, elastic band 20 is sewn or otherwise attached around the opening of brush cover 18. Elastic band 20 may be formed of ribbed or any similar material of sufficient resilience and strength to hold brush cover 18 over brush head 14. In alternative embodiments, other means to hold brush cover 18 over brush head 14 may be employed, such as the use of straps that connect by means of Velcro tabs or other connection means, or by a closure that is sealed by means of Velcro or other connection means. Handle loop 22 is sewn or otherwise attached to brush cover 18, preferably at the edge where brush cover 18 meets elastic band 20. Handle loop 22 is sized to receive handle 12, and may be formed of cloth, cord, or any other sufficiently pliable and strong material to hold brush cover 18 in place with respect to handle 12 and brush head 14.

Handle cover 24 is preferably formed of the same material as brush cover 18, preferably sheepskin but alternatively any other sufficiently soft material to prevent damage to a vehicle or other delicate surface during washing. Handle cover 24 is sized such that its width is sufficient to wrap around the circumference of handle 12, and its length is sufficient to cover a sufficiently long portion of handle 12 that any impact between a vehicle's surface and handle 12 is likely to occur along the length of handle cover 24 when attached as described below. Preferably, handle cover 24 does not extend the entire length of handle 12 so that there remains room at the end of handle 12 opposite brush head 14 for the user to grip handle 12 without contacting handle cover 24.

Handle cover 24 is preferably held in place around handle 12 by means of Velcro along its longer edge (not shown). In an alternative embodiment, handle cover 24 may be sewn together, in which case it is attached by slipping it over the end of handle 12. Other common attachment means may be employed in alternative embodiments. Brush cover strap 26 preferably extends from one of the shorter edges of handle cover 24, and may be formed of cloth, cord, or any other sufficiently strong material to hold handle cover in place without breaking during use. It preferably attaches back to itself in a loop fashion by means of Velcro patch 26, a snap, or other attachment means. Alternatively, the free end of brush cover strap 26 may attach back to handle cover 24 or handle 12 by means of Velcro or other attachment means.

To attach brush cover 18 and handle cover 24 to brush 10, the following steps are preferably employed. Handle loop 22 is first fitted over the end of handle 10 and slid down to the point where handle 12 meets brush head 14. This method may be employed for brushes 10 of the simple type typically employed for home use, where the end of handle 12 opposite to brush head 14 is free. In the case where brush 10 is of the type typically employed at self-service car washes, where the free end of handle 12 is usually attached to a hose to receive soapy water, handle loop 22 may be releasably attached at one end, such as by Velcro or other means, and may be released, wrapped around handle 12 near the end of handle 12 where it attaches to brush head 14, and then reattached. In either case, brush cover 18 may then be fitted over brush head 14 and bristles 16 by stretching elastic band 20 and inserting brush head 14 into the interior portion of brush cover 18. Elastic band 20 and handle loop 22 will then both serve to hold brush cover 18 securely in place over bristles 16 during washing, thereby preventing damage to a vehicle or other delicate surface by bristles 16 during washing.

To attach handle cover 24 to brush handle 12, the following steps are preferably employed. Handle cover 24 is first wrapped around handle 12 near the end where brush head 14 is attached. The Velcro or other attachment means are then closed such that the result is complete coverage of a lower portion of handle 12 by handle cover 24. If handle cover 24 is sewn together, as described above with respect to an alternative embodiment, then it may be slipped over handle 12 and down into place. The free end of brush cover strap 26 is then slipped through handle loop 22, and attached back to itself, preferably at Velcro strap 25, or handle 12, as applicable in particular embodiments. It will be seen that the employment of brush cover strap 26 in this manner will prevent slippage of brush cover 24 longitudinally along handle 12 during washing, and brush cover 24 will thus be held in place at the end of handle 12 adjacent to brush head 14. This will protect a vehicle or other delicate surface from damage due to impact with handle 12, since handle cover 12 will soften any such impact.

The present invention has been described with reference to certain preferred and alternative embodiments that are intended to be exemplary only and not limiting to the full scope of the present invention as set forth in the appended claims. It may be noted that while the invention is described as being useful for the purpose of washing vehicles, the invention is not so limited and may be employed in the cleaning or washing of any surface for which it is desired that the surface be protected from damage due to brush bristles or impact by a brush handle.

What is claimed is:

1. A brush mitt removably attachable to a carwash brush, the brush comprising a handle comprising first and second ends, a brush head attached to the first end of the handle and a hose securely attached to the second end of the handle, and a plurality of bristles attached to the brush head, the brush mitt comprising:

(a) a brush cover comprising an opening to receive the brush head wherein said brush cover is configured to be removably attachable to the brush head and wherein the brush cover entirely covers the plurality of bristles;

(b) a releasably closeable handle loop attached to said brush cover and sized to receive the handle and a handle cover attachment strap through said releasably closeable handle loop; and (c) a handle cover configured to be attached to the handle above the brush head and comprising a first and second short side and a first and second long side, wherein said handle cover removably attaches to the handle above the brush head by connecting said first and second long sides of said handle cover;

wherein the handle cover attachment strap comprises first and second ends, wherein said first end is attached to said first short side of said handle cover and said second end is releasably attachable to said first short side of said handle cover, and further wherein said handle cover attachment strap passes through said releasably closeable handle loop, whereby said handle cover is secured to said brush cover.

2. The brush mitt of claim 1, wherein said brush cover comprises an elastic band attached around said opening.

3. The brush mitt of claim 2, wherein said brush cover is sized to cover the plurality of bristles attached to the brush head.

4. The brush mitt of claim 3, wherein at least one of said brush cover and said handle cover comprise sheepskin.

5. The brush mitt of claim 1, wherein said first and second long sides of said handle cover comprise hook-and-loop fasteners.

6. A car washing apparatus, comprising:

(a) a brush comprising a handle comprising first and second ends;

(b) a brush head attached at said first end of said handle;

(c) a hose securely attached at said second end of said handle, wherein said hose is adapted to deliver soapy water through said handle to said brush head;

(d) a plurality of bristles attached at said brush head;

(e) a brush cover comprising an opening to receive said brush head wherein said brush cover is attached to the washing apparatus at said brush head and wherein the brush cover entirely covers the plurality of bristles;

(f) a releasably closeable handle loop attached to said brush cover and sized to receive said handle through said releasably closeable handle loop and to receive a handle cover attachment strap; and (g) a handle cover configured to be attached to said handle above said brush head and comprising a first and second short side and a first and second long side, wherein said handle cover removably attaches to said handle above said brush head by connecting said first and second long sides of said handle cover;

wherein the handle cover attachment strap comprises first and second ends, wherein said first end is attached to said first short side of said handle cover and said second end is releasably attachable to said first short side of said handle cover, whereby said handle cover attachment strap passes through said releasably closeable handle loop, whereby said handle cover is secured to said brush cover.

7. The washing apparatus of claim 6, wherein said brush cover comprises an elastic band attached around said opening.

8. The washing apparatus of claim 7, wherein said brush cover is sized to cover said plurality of bristles attached to said brush head.

9. The washing apparatus of claim 8, wherein at least one of said brush cover and said handle cover comprise sheepskin.

10. The washing apparatus of claim 6, wherein said first and second long sides of said handle cover comprise hook-and-loop fasteners.

11. The brush mitt of claim 1, wherein said releasably closeable handle loop comprises a permanently attached end permanently attached to said brush cover and a releasably attached end.

12. The brush mitt of claim 11, wherein said releasably attached end of said releasably closeable handle loop comprises a first handle loop hook-and-loop fastener surface, and said brush cover comprises a second handle loop hook-and-loop fastener surface positioned on said brush cover to receive said releasably attached end of said releasably closeable handle loop, wherein the connection of said first and second hook-and-loop fastener surfaces may close said releasably closeable handle loop around the handle.

13. The washing apparatus of claim 6, wherein said releasably closeable handle loop comprises a permanently attached end permanently attached to said brush cover and a releasably attached end.

14. The brush mitt of claim 13, wherein said releasably attached end of said releasably closeable handle loop comprises a first handle loop hook-and-loop fastener surface, and said brush cover comprises a second handle loop hook-and-loop fastener surface positioned on said brush cover to receive said releasably attached end of said releasably closeable handle loop, wherein the connection of said first and second hook-and-loop fastener surfaces may close said releasably closeable handle loop around said handle.

* * * * *